US010306978B2

(12) United States Patent
Morag et al.

(10) Patent No.: US 10,306,978 B2
(45) Date of Patent: Jun. 4, 2019

(54) POKER TABLE AND METHOD FOR OPERATING THEREOF

(71) Applicant: GAMING PATENTS LTD, Ramat Gan (IL)

(72) Inventors: Tamir Morag, Ramat Gan (IL); Lazar Eli Diamant, Ramat-Gan (IL)

(73) Assignee: GAMING PATENTS LTD, Ramat Gan (IL)

( * ) Notice: Subject to any disclaimer, the term of this patent is extended or adjusted under 35 U.S.C. 154(b) by 0 days.

(21) Appl. No.: 16/068,109

(22) PCT Filed: Jan. 18, 2017

(86) PCT No.: PCT/IL2017/050073

§ 371 (c)(1),
(2) Date: Jul. 4, 2018

(87) PCT Pub. No.: WO2017/125927

PCT Pub. Date: Jul. 27, 2017

(65) Prior Publication Data

US 2019/0021489 A1 Jan. 24, 2019

(30) Foreign Application Priority Data

Jan. 19, 2016 (IL) ..... 243685
Jan. 15, 2017 (IL) ..... 250127

(51) Int. Cl.

| | |
|---|---|
| ***A63F 1/14*** | (2006.01) |
| ***A47B 25/00*** | (2006.01) |
| ***A63F 1/06*** | (2006.01) |
| *A63F 1/12* | (2006.01) |
| *A63F 3/00* | (2006.01) |

(52) U.S. Cl.

CPC ..... *A47B 25/00* (2013.01); *A63F 1/067* (2013.01); *A63F 1/14* (2013.01); *A63F 1/12* (2013.01); *A63F 3/00157* (2013.01); *A63F 2003/00164* (2013.01)

(58) Field of Classification Search

CPC ..... A63F 1/14; A63F 1/12; A63F 2001/001; A63F 2001/003; A63F 2001/005; A63F 3/00157; A63F 2003/00164; A63F 11/002
USPC ..... 273/149 R, 149 P, 309, 274, 292; 463/22
See application file for complete search history.

(56) References Cited

U.S. PATENT DOCUMENTS 1,889,729 A 11/1932 Hammond
2,051,615 A * 8/1936 Miles ..... A63F 1/14 273/149 P (Continued)

FOREIGN PATENT DOCUMENTS

| | | |
|---|---|---|
| CN | 2877425 | 3/2007 |
| CN | 2887138 | 4/2007 |
| CN | 201123530 | 10/2008 |

OTHER PUBLICATIONS

Israel Patent Office Search Report for PCT patent application PCT/IL2017/050073, dated May 7, 2017, 10 pages.

(Continued)

*Primary Examiner* — Benjamin Layno
(74) *Attorney, Agent, or Firm* — Mark M. Friedman

(57) ABSTRACT

The invention relates to a system and method to improve efficiency of poker game by using an upper and a bottom sophisticated dispenser in poker tables.

19 Claims, 9 Drawing Sheets

(56) References Cited

U.S. PATENT DOCUMENTS

| | | | | |
|---|---|---|---|---|
| 6,361,044 | B1 * | 3/2002 | Block | A63F 1/14 273/148 R |
| 8,740,218 | B2 * | 6/2014 | Just | A63F 1/14 273/149 R |
| 2013/0020761 | A1 * | 1/2013 | Sines | A63F 1/12 273/149 R |
| 2015/0224389 | A1 | 8/2015 | Stasson et al. | |

OTHER PUBLICATIONS

Israel Patent Office Search Report for Israel patent application IL250127, dated Jun. 4, 2017, 6 pages.

* cited by examiner

FIG 1 -STEPS 1,2,3,6

FIG 2 - STEPS 4,5

POKER TABLE AND METHOD FOR OPERATING THEREOF

FIELD OF THE INVENTION

The invention relates to a method to improve the efficiency of poker. More particularly, the invention relates to a method and apparatus for improving the game by using a sophisticated dispenser in poker tables.

CROSS-REFERENCE TO RELATED APPLICATIONS

The present application claims priority tea IL application no 243685 filed on Jan. 19, 2016 and IL application no 250127 filed on Jan. 15, 2017. The content of both applications is incorporated by reference herein in its entirety.

BACKGROUND OF THE INVENTION AND PRIOR ART

A poker table is a table specifically designed for playing card games, usually poker. The players sit around the table. A professional poker table in a casino or a game room is divided into up to ten zones. Each zone is designated to one player. It is common that a dealer distributes the cards to the players.

During each game, a sum of money is invested by the players, and the poker club earns a fraction, therefore the club is interested in increasing the number of games per period, and the period of distributing the cards to players is a non-utilized period.

The intention of the invention is, to provide a solution for non-utilized periods, by introducing a more sophisticated table and method of operating thereof.

SUMMARY OF THE INVENTION

The invention describes a novel poker table divided into table zones, usually, about ten, depending on the size of the table. Each zone is designated for a player.

According to one embodiment of the invention a poker table is described where a cards distribution assembly is disposed at the center of the poker table and upon pressing a button by the dealer a vertically movable cover of the cards distribution assembly lifts.

The cards distribution assembly distributes the cards to each of the players from below the vertically movable cover.

When cards are dealt, the vertically movable cover descends back to the height of the rest of the table, i.e., to the height of table zones.

In another embodiment of the invention narrow grooves are located around the inner contour of the encircling wooden banister (Rail) of the table, one for each zone. Each groove is located in front of each player and the game cards pop out through the grooves and laid face down in front of the player.

The tracks through which the cards are conveyed are located underneath the table. One track for each zone. The conveyed cards may be stored in storage compartments located underneath the table near the grooves. The cards in the storage compartments are simultaneously dealt to the players by pressing a button by the dealer.

The cards are shuffled below the table in a shuffling machine connected to the main track. The cards are ejected from the shuffling machine through the main track to a cartridge. The cartridge is an interject station from which the cards are transferred to dispenser by any known transporting/conveying mechanism. The cartridge is designed to store up to four packs of game cards in its four small compartments. The main track exits the cartridge to a distributing device (dispenser) that distributes the cards to the conveying tracks, which lead the cards to the storage compartments.

An embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments, of the inventions. It is understood that the phraseology and terminology employed herein is not to be construed as limiting and are for descriptive purpose only.

BRIEF DESCRIPTION OF THE DRAWINGS

The Embodiments and features of the inventions are best described and explained in conjunction with the drawings.

Embodiments of the present disclosure are herein after described in conjunction with the following figures, wherein like numeral denote like elements. The figures are provided for illustration and depict exemplary embodiments of present disclosure. The figures are provided to facilitate understanding of present disclosure without limiting the breadth, scope, scale or applicability of present disclosure. The numeral denotes in parentheses are old numbers that were used in the priority application and had to be renumbered to avoid confusion caused by the incorporation of both applications.

The drawings are not necessarily drawn to scale.

DETAILED DESCRIPTION OF THE PREFERRED EMBODIMENTS

The invention wilt be understood from the following detailed description of embodiments of the invention, which are meant to be descriptive and not limiting. For the sake of brevity, some well-known features, methods, systems, procedures, components, and so on, are not described in detail.

Figure 1:
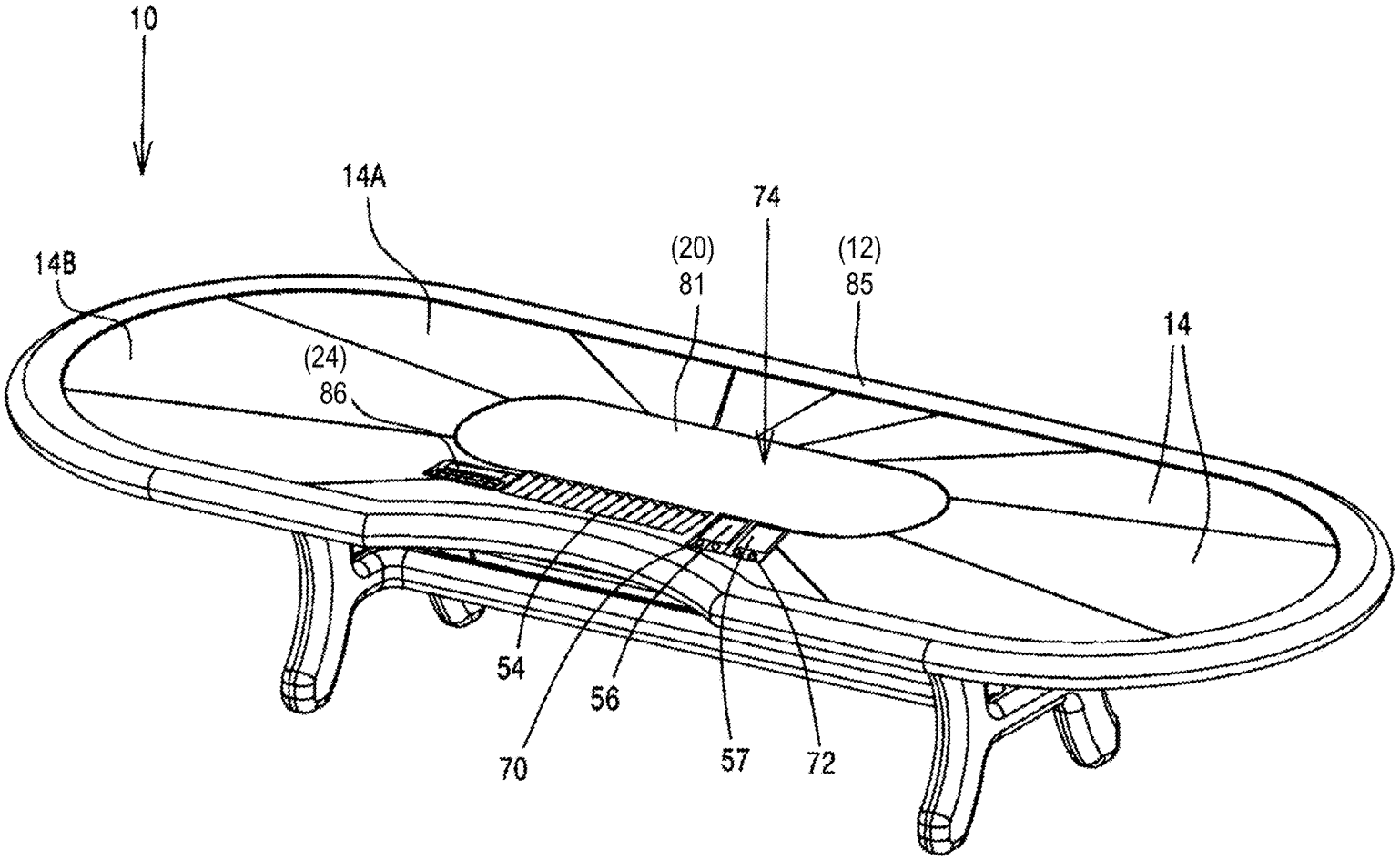
FIG. 1 depicts a poker table, including a distributing assembly, at the first to third steps, according to one embodiment of the invention.

According to one embodiment of the invention, as shown in FIG. 1, a poker table 10 includes a cards distribution assembly 74 disposed at the center of poker table 10.

At the first step, the dealer inserts a non-shuffled packet into an insertion box 56 of a shuffling machine and presses button 70.

Then, at the second step, the shuffling machine shuffles the packet of box 56. The shuffled packet is transferred to box 57 manually or automatically.

Figure 2:
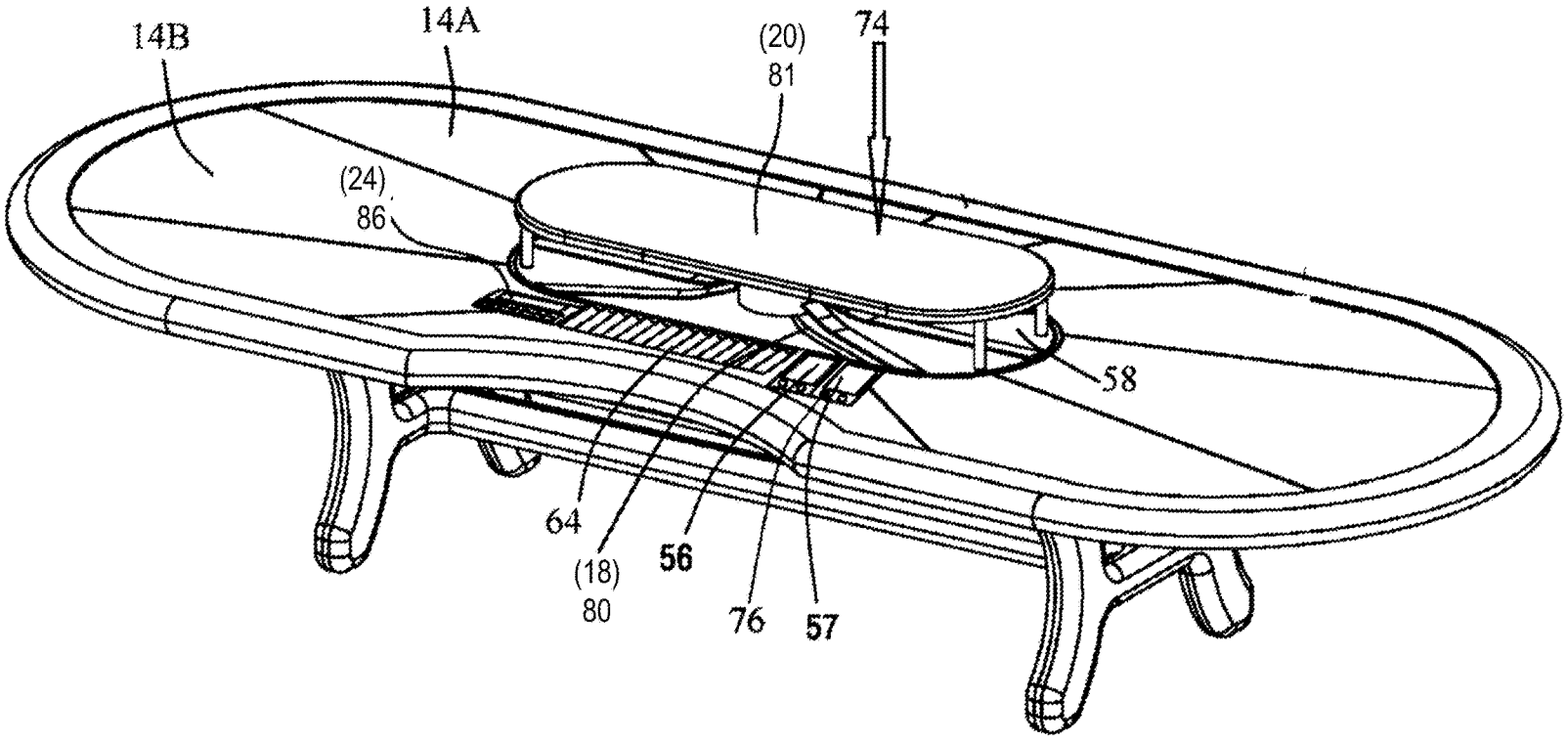
FIG. 2 depicts the poker table of FIG. 1, upon lifting the table of the cards distribution assembly, according to one embodiment of the invention.

Then at the third step, a cards transferring mechanism $\mathbf{80}_{(18)}$, shown in FIG. 2 transfers some of the cards of the packet of box 56, from box 57, or from another box, into cards distribution assembly 74.

FIG. 2 depicts the poker table of FIG. 1, upon lifting the table of the cards distribution assembly.

At the fourth step, which is upon pressing a button 76, the dealer takes the rest of the shuffled packet out of box 57, and a vertically movable cover $\mathbf{81}_{(20)}$ of cards distribution assembly 74 lifts.

At the fifth step, cards distribution assembly 74 distributes cards, from below vertically movable cover $\mathbf{81}_{(20)}$, to each of the players.

At the sixth step, vertically movable cover $\mathbf{81}_{(20)}$ descends back to the height of the rest of the main table, i.e., to the height of table zones 14A and 14B, as depicted in FIG. 1.

Figure 3:
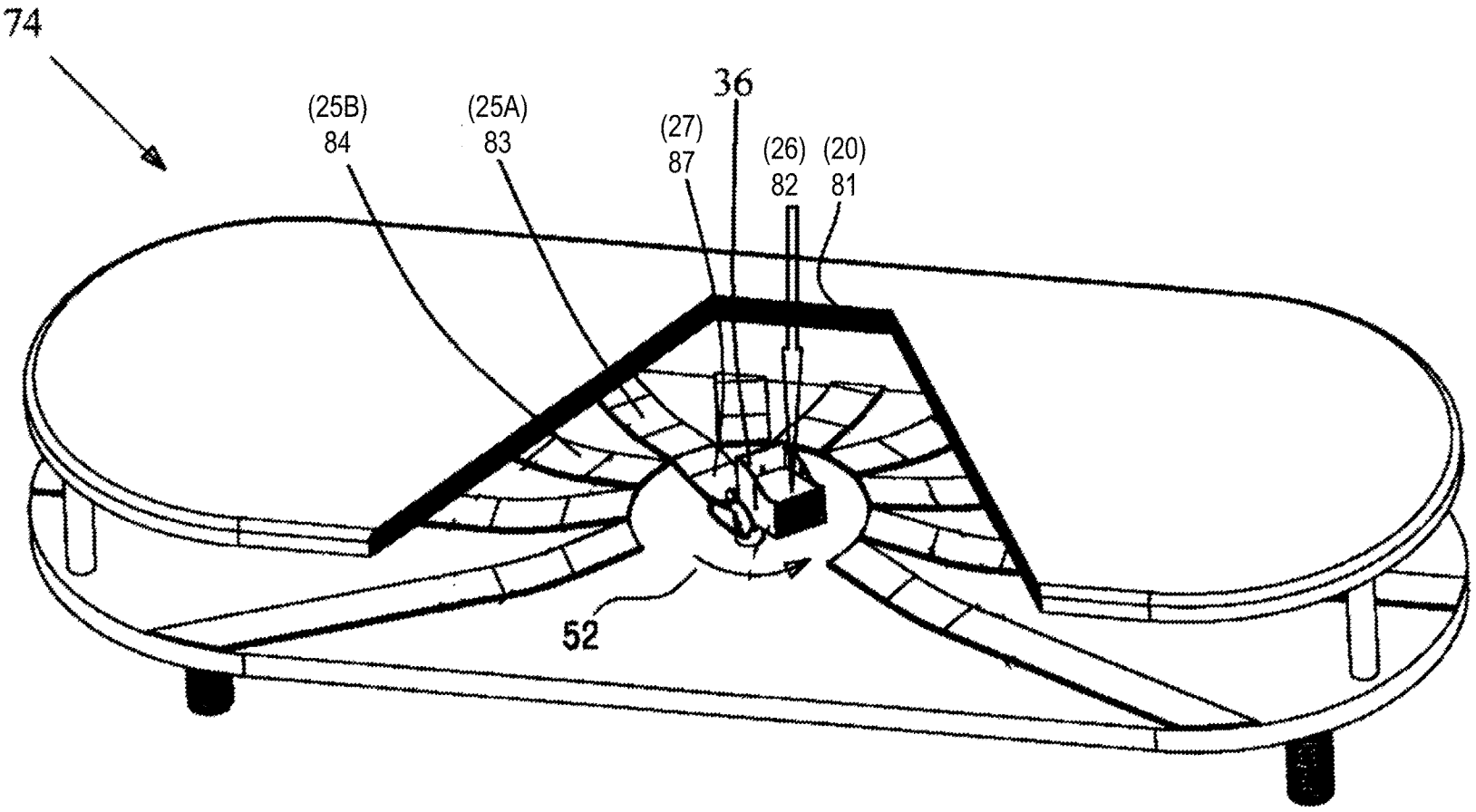
FIG. 3 focuses on the cards distribution assembly of FIG. 1, for detailing how the cards distribution assembly performs the fifth step, described in FIG. 2, according to one embodiment of the invention.

FIG. 3 focuses on the cards distribution assembly of FIG. 1, showing the vertically movable cover $\mathbf{81}_{(20)}$ broken, for detailing how the cards distribution assembly performs the fifth step, described in FIG. 2.

At the third step, described in FIG. 1, of which some of the cards of the packet of box 56 have been transferred from box 57 into cards distribution assembly 74, the cards have been transferred into a rotatable cartridge $\mathbf{82}_{(26)}$ of cards distribution assembly 74.

At the fifth step, in which cards distribution assembly 74 distributes the cards, from rotatable cartridge $\mathbf{82}_{(26)}$, to each of the players, an outlet 36 of cartridge $\mathbf{82}_{(26)}$ faces a first table zone 14A (enumerated in FIG. 2), and removes several cards, say four cards from cartridge $\mathbf{82}_{(26)}$ to a first platform $\mathbf{83}_{(25A)}$.

Then, cartridge $\mathbf{82}_{(26)}$ rotates, as depicted by arrow 52, for making outlet 36 to face a second table zone 14B (enumerated in FIG. 2), and removes several cards, say four cards from cartridge $\mathbf{82}_{(26)}$, to a second platform $\mathbf{84}_{(25B)}$, and so on.

After removing the cards from outlet 36 of cartridge $\mathbf{82}_{(26)}$ to platforms $\mathbf{83}_{(25A)}$, to $\mathbf{84}_{(25B)}$, etc., the removed cards are thrown altogether simultaneously, each through the platform thereof to its table zone, i.e., from platform $\mathbf{83}_{(25A)}$ to table zone 14A, from platform $\mathbf{84}_{(25B)}$ to table zone 14B, etc.

Platforms $\mathbf{83}_{(25A)}$, $\mathbf{84}_{(25B)}$, etc. are shaped as a track, for directing the cards thereof to the table zone associated thereto. For instance, platform $\mathbf{83}_{(25A)}$ is shaped as a track, for directing the cards thereof to table zone 14A only. Thus, platform/track $\mathbf{83}_{(25A)}$ provides that a non-significant air pressure or push or kicking on the card is sufficient for reliably moving the card from platform $\mathbf{83}_{(25A)}$ and there through, to land on table zone 14A.

Figure 4:
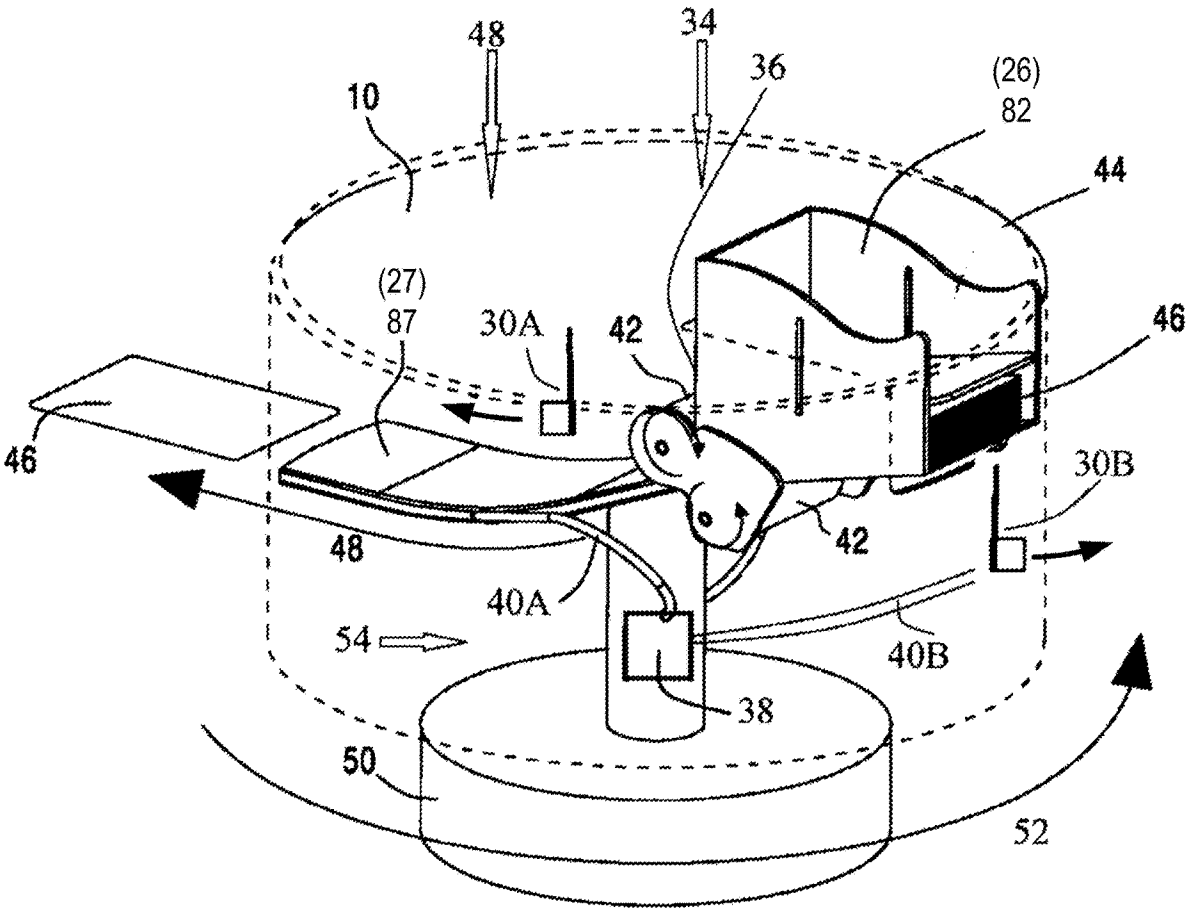
FIG. 4 focuses on the center of the cards distribution assembly of FIG. 1, according to one embodiment of the invention.

FIG. 4 focuses on the center of the cards distribution assembly of FIG. 1. A step motor 50 carries cartridge $\mathbf{82}_{(26)}$, for providing the rotation 52 of cartridge $\mathbf{82}_{(26)}$, described in FIG. 3.

A card removing mechanism 34, such as motorized cylinders 42, provide the removal of the cards 46 from cartridge $\mathbf{82}_{(26)}$, described in FIG. 3.

A card throwing mechanism 48 provides the throwing of cards 46, described in FIG. 3.

According to one embodiment, card throwing mechanism 48 includes an air pump 38 for supplying pressurized air to an air pipe 40A, for blowing air on cards 46.

According to another embodiment, card throwing mechanism 48 includes an electro-mechanical hammer 30A, for kicking one card 46 at a time, or several cards simultaneously.

Card throwing mechanism 48 is adapted to perform the throwing of all of the removed cards 46 simultaneously, such as by including hammer 30A for kicking cards 46 towards table zone 14A, and another hammer 30B for simultaneously kicking cards 46 towards table zone 14B; or by including pipe 40A for blowing cards 46 towards table zone 14A, and another pipe 40B for blowing cards 46 towards table zone 14B.

Cartridge $\mathbf{82}_{(26)}$, step motor 50 and card throwing mechanism 48 are packaged by a package 44.

Figures 5, 6:
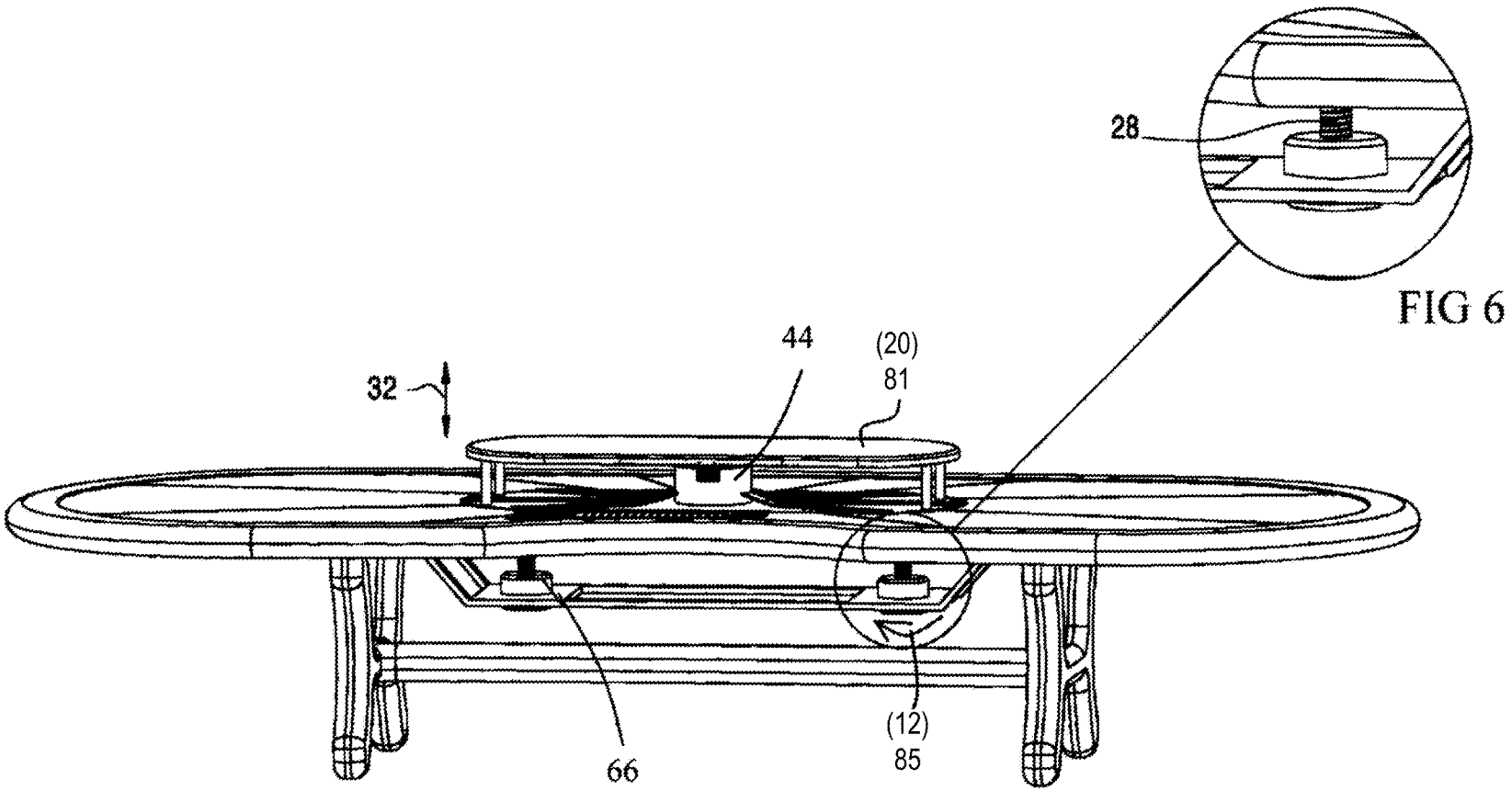
FIG. 5 depicts the bottom of the cards distribution assembly of FIG. 1, according to one embodiment of the invention.
FIG. 6 magnifies the mechanism for lifting the vertically movable cover of the cards distribution assembly of FIG. 1, according to one embodiment of the invention.

FIG. 5 depicts the bottom of the cards distribution assembly of FIG. 1.

FIG. 6 magnifies the mechanism for lifting the vertically movable cover of the cards distribution assembly of FIG. 1.

The lifting and descending steps of vertically movable cover $\mathbf{81}_{(20)}$ of cards distribution assembly 74 may be applied by motors 66 for rotating threads 28, for converting torque $\mathbf{85}_{(12)}$ thereof to vertical linear motion 32 of vertically movable cover $\mathbf{81}_{(20)}$.

Thus, in one aspect, the invention is directed to a poker table 10, including an assembly 74, for distributing cards 46 to various table zones 14A, 14B of poker table 10.

The cards distribution assembly 74 may be adapted to perform the distribution of the cards 46 to various table zones 14A, 14B simultaneously.

The cards distribution assembly 74 may include:

- a cartridge $\mathbf{82}_{(26)}$, for housing the cards 46 to be distributed;
- a step motor 50, for rotating cartridge $\mathbf{82}_{(26)}$, for inducing an outlet 36 thereof to face at each rotational state of cartridge $\mathbf{82}_{(26)}$, one of the table zones 14A, 14B, associated with that rotational state;
- a card removing mechanism 34, for removing, on each of the rotational states, at least one card 46 from cartridge 36 onto a platform (25A, 25B) associated with one of the table zones (14A, 14B); and
- a card throwing mechanism (48), for throwing the removed cards (46), from each of the platforms $\mathbf{83}_{(25A)}$, $\mathbf{84}_{(25B)}$ to table zones 14A, 14B associated therewith.

Card throwing mechanism 48 may include at least one air blowing mechanism 54 for blowing the cards, or at least one hammer 30A, for kicking the cards.

At least one air blowing mechanism 54 and/or the at least one hammer 30A may include a separate mechanism for each of table zones 14A, 14B, thereby the card throwing mechanism 48 may be adapted to perform the throwing of all of the removed cards 46 simultaneously.

Card throwing mechanism 48 may be adapted to perform the throwing of all of removed cards 46 simultaneously.

Cards distribution assembly 74 may be disposed substantially at the center of poker table 10, between table zones 14A, 14B.

Cards distribution assembly 74 may include a vertically movable cover $\mathbf{81}_{(20)}$, for being disposed at the height of table zones 14A, 14B, while not distributing cards 46, and for being disposed above the height of table zones 14A, 14B while distributing cards 46, for forming gap 58 between vertically movable cover $\mathbf{81}_{(20)}$ and table zones 14A, 14B, for distributing the cards there through.

Poker table 10 may further include a cards transferring mechanism $\mathbf{80}_{(18)}$, for transferring cards from shuffling machine 56, 57 into cards distribution assembly 74.

Cards transferring mechanism $\mathbf{80}_{(18)}$, for transferring cards from shuffling machine 56, 57 into cards distribution assembly 74 may include:

a card removing mechanism (like 34) for removing cards 46 from shuffling machine 56, 57 onto a platform [like $\mathbf{83}_{(25A)}$, $\mathbf{84}_{(25B)}$]; and a card throwing mechanism (like 48), for throwing removed cards 46, from each of the platforms [like $\mathbf{83}_{(25A)}$, $\mathbf{84}_{(25B)}$] into cards distribution assembly 74.

In another aspect, the invention is directed to a method for operating a poker table 10, the method including the step of:

distributing cards 46 by assembly 74, from a center of poker table 10 to various table zones (14A, 14B) thereof, each associated with an active player, and not distributing to table zones which are not currently used by active players.

The distribution of cards 46 to the various table zones (14A, 14B) may be simultaneous.

The distribution of cards 46 may include the steps of:

rotating cartridge $\mathbf{82}_{(26)}$ housing cards 46, for inducing an outlet 36 of cartridge $\mathbf{82}_{(26)}$ to face at each rotational state of cartridge $\mathbf{82}_{(26)}$, one of the table zones (14A, 14B), associated with that rotational state;

removing, on each of the rotational states, at least one card 46 from cartridge 36 onto a platform $\mathbf{83}_{(25A)}$, $\mathbf{84}_{(25B)}$ associated with one of table zones 14A, 14B; and throwing the removed cards 46, from each of the platforms $\mathbf{83}_{(25A)}$, $\mathbf{84}_{(25B)}$ to table zones 14A, 14B associated therewith.

In the figures and/or description herein, the following reference numerals (Reference Signs List) have been mentioned:

numeral 10 denotes the poker table according to one embodiment of the invention;

numeral $\mathbf{85}_{(12)}$ denotes rotational movement;

numerals 14A and 14B denote different table zones, each for one player;

numeral $\mathbf{80}_{(18)}$ denotes a cards transferring mechanism;

numeral $\mathbf{81}_{(20)}$ denotes a vertically movable cover of the cards distribution assembly;

numeral $\mathbf{86}_{(24)}$ denotes a keyboard for inputting parameters to a controller operating the shuffling box and the cards distribution assembly;

numerals $\mathbf{83}_{(25A)}$ and $\mathbf{84}_{(25B)}$ denote platforms, each associated with one table zone, the platforms for removing the cards from the cartridge thereto, and for then throwing the cards there through; preferably the platforms are shaped as tracks; for the embodiment throwing the cards by air blowing, the platforms may include air channels;

numeral $\mathbf{87}_{(27)}$ denotes a tray, which may fixed to the cartridge and be rotated thereby, such that the tray provides continuity from the outlet of the cartridge to each of the platforms, one at a time;

numeral 28 denotes a thread;

numerals 30A and 30B denote hammers, each for kicking cards to a different table zone;

numeral 32 denotes vertical motion of the vertically movable cover;

numeral 34 denotes the card removing mechanism;

numeral 36 denotes the outlet of the cartridge;

numeral 38 denotes an air pump;

numerals 40A and 40B denote air pipes, each for blowing cards to a different table zone;

numeral 42 denotes a motorized wheel;

numeral 44 denotes a package:

numerals 46 denote a card;

numeral 48 denotes the card throwing mechanism;

numeral 52 denotes an arrow indicating the rotation of the cartridge;

numeral 54 denotes the air blowing mechanism;

numeral 56 denotes an insertion box of a shuffling machine;

numeral 57 denotes a box of the shuffling machine for removing the shuffled cards;

numeral 58 denotes a gap between the vertically movable cover and the table zones, formed by lifting the vertically movable cover;

numeral 64 denotes a chips tray;

numeral 66 denotes a motor;

numerals 70 and 72 denote operating buttons;

numeral 74 denotes the cards distribution assembly;

numeral 76 denotes another operating button;

Any term that has been defined above and used in the claims, should be interpreted according to this definition.

Figures 7, 7A:
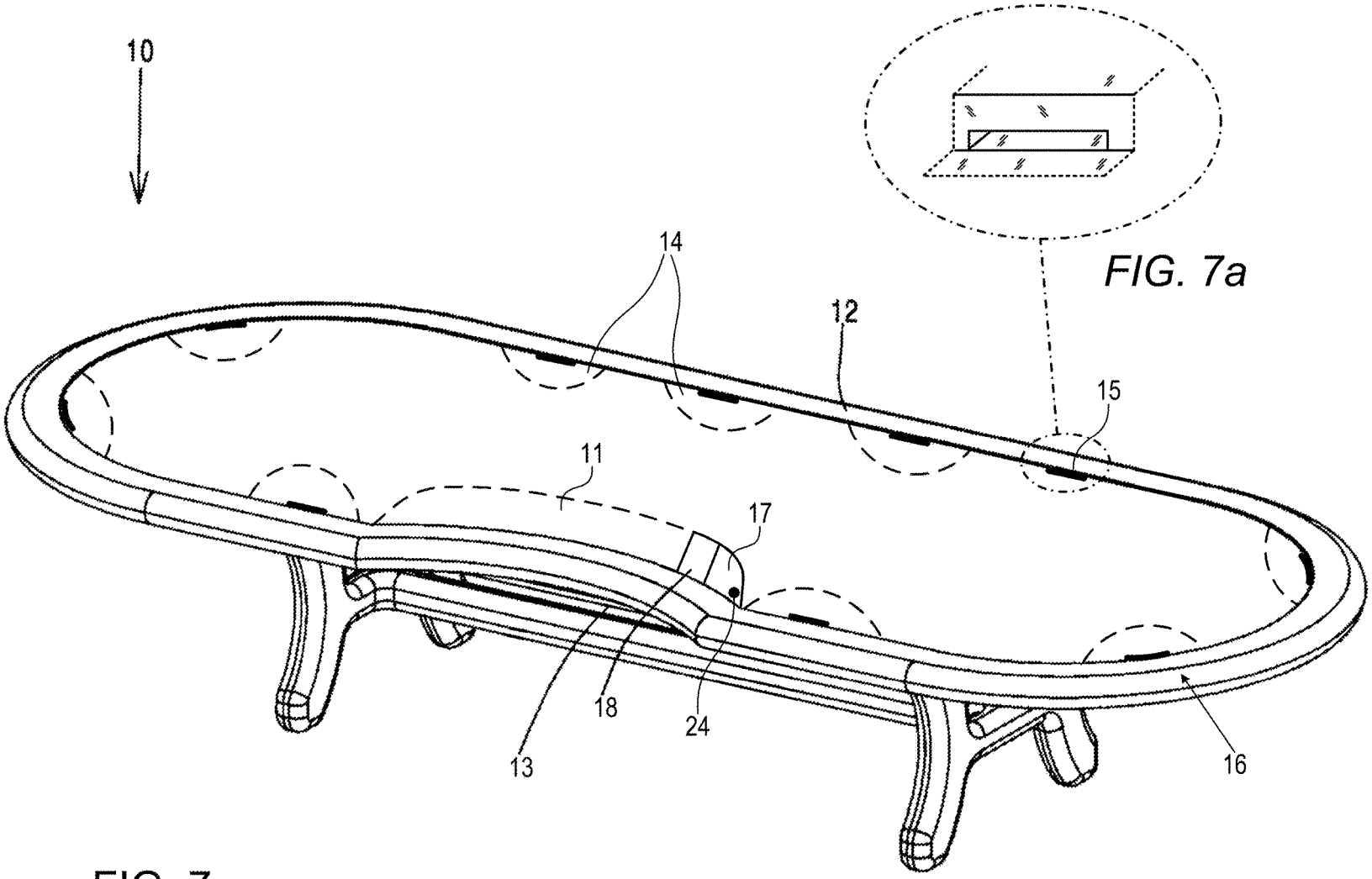
FIG. 7 shows the poker table from above, according to another embodiment of the invention.
FIG. 7*a* shows a detailed version of the groove of FIG. 7.

Another embodiment of the invention (FIG. 7) describes a novel poker table 10 divided into table zones 14, usually, about ten, depending on the size of the table. Each zone is designated for one player. A narrow groove 15 is located around the inner contour 12 of the encircling wooden banister (rails) 16, one for each zone. Each groove 15 is located in front of each player and the game cards pop out through grooves 15 and laid face down in front of the player (FIG. 7*a*). Dealer zone 11 is located in front of table mechanism 13.

On the table, in front of the dealer are 2 openings for boxes, which are located underneath the table. The boxes are attached to, or part of shuffling machine 21 (described in FIG. 8). Box 17 for new shuffled cards to be distributed to players and box 18 for used or unused cards, which are directed to shuffling machine 21. When dealer presses button 24 the cards are shot to the players. Button 24 is part of shuffling machine 21 and when pressing button 24 shuffling machine 21 starts to shuffle and at the same time cards are shot to the players.

Figure 8:
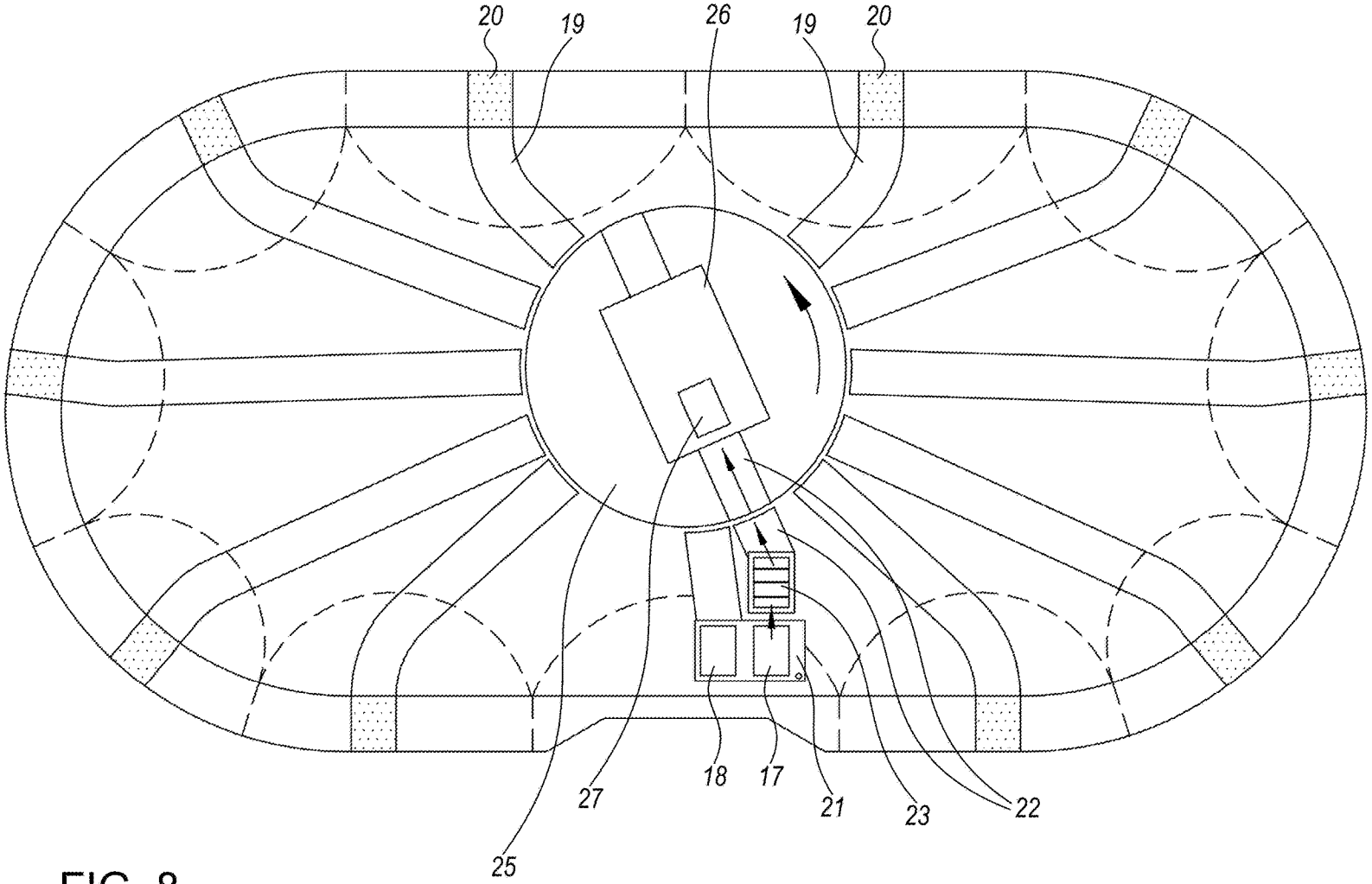
FIG. 8 shows the poker table from underneath, at the first stage of retrieving cards into the cards dispenser, according to another embodiment of the invention.

Tracks 19 through which the cards are conveyed, are located underneath the table (FIG. 8). One track for each zone. The conveyed cards are stored in storage compartments 20 underneath the table near grooves 15. The cards in storage compartments 20 are simultaneously dealt to the players when dealer presses button 24.

The cards are shuffled below the table in shuffling machine 21. The cards are ejected from shuffling machine 21 to cartridge 23. Cartridge 23 is an interject station located between box 17 and main track 22. Cartridge 23 is designed to store up to four packs of shuffled game cards in its four small compartments. Main track 22 exits cartridge 23 into turning disk 25 where dispenser 26 is located. Dispenser 26 distributes the cards to conveying tracks 19 (FIG. 8) which lead the cards to storage compartments 20, from where the cards pop up through grooves 15.

Dispenser 26 is located on turning disk 25. FIG. 8 shows main track 22 facing cartridge 23 to be loaded with a deck of cards. The cards which are to be dealt to the players are separated from the deck by a roller devise installed in dispenser 26, dragging the cards from compartment 27.

Figure 9:
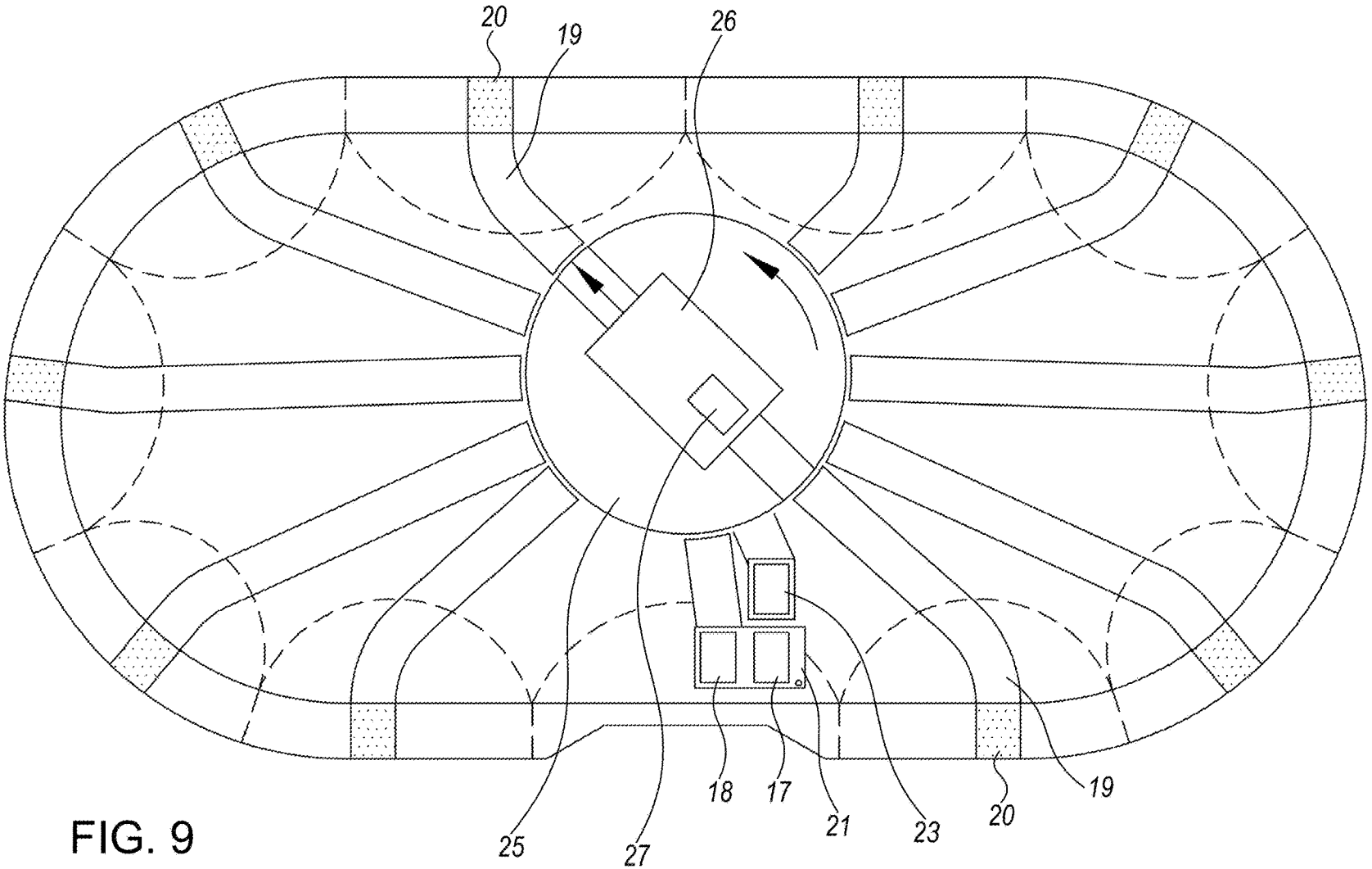
FIG. 9 shows the poker table from underneath, at the stage of distributing the cards to storage compartments, according to another embodiment of the invention.
Figure 10:
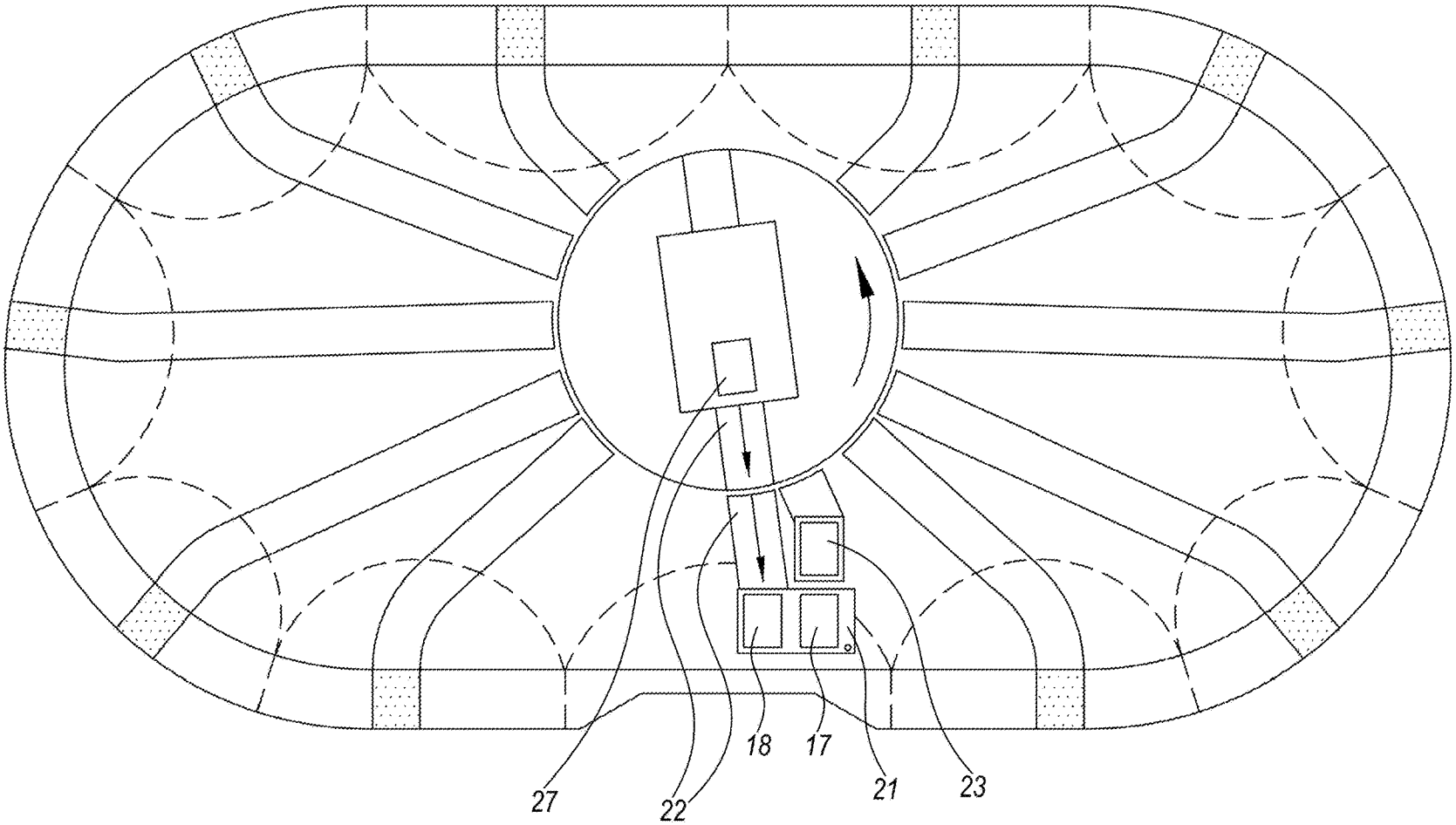
FIG. 10 shows the poker table from underneath, at the stage of returning the remainder of the deck of cards into a compartment in the shuffler, according to another embodiment of the invention.

When cards are in dispenser 26, turning disk 25 turns around (as shown in FIG. 9) and dispenses the separated cards through tracks 19 to storage compartments 20 in front of each participant player, while skipping the unoccupied seats.

The remaining cards, which were not dealt to players and remained in dispenser 26 are returned through main track 22 to box 18 in shuffling machine 21.

What is claimed:

1. A card distribution system comprising:

a card distributor comprising:

a rotatable cartridge configured for receiving a plurality of cards; and, a card remover in communication with the cartridge and rotatable with the cartridge, the card remover configured for removing at least one card from the cartridge by directly contacting the at least one card and for providing a pushing force directly on the at least one card; and, a plurality of conduits arranged around the card distributor, each conduit of the plurality of conduits arranged to receive at least one card from the cartridge when the cartridge has been rotated into alignment with said each conduit, such that said each conduit is in communication with the card remover, and the pushing force from the card remover is sufficient for propelling the at least one card through said each conduit.

2. The card distribution system of claim 1, additionally comprising: a tray in communication with the card remover, the tray for rotation with the cartridge and alignment with said each conduit.

3. The card distribution system of claim 1, wherein said each conduit is positioned along an arc with respect to the card distributor, which is positioned substantially centrally with respect to said each conduit.

4. The card distribution system of claim 1, additionally comprising a table divided into zones, each zone including an opening in communication with said each conduit, each said opening through which the at least one card enters the table.

5. The card distribution system of claim 4, wherein the card remover includes, a plurality of motors, and, at least one pair of oppositely rotating cylinders driven by each of the motors, the rotating cylinders for providing a force on the at least one card sufficient to propel the at least one card through said each conduit and onto the table.

6. The card distribution system of claim 4, additionally comprising: a card propulsion mechanism including at least one of:

a blower in communication with said each conduit for blowing air into said each conduit at a force sufficient to propel the card through said each conduit and onto the table; and, a hammer in communication with the cartridge, for striking the at least one removed card with a force sufficient to propel the card through said each conduit.

7. The card distribution system of claim 4, additionally comprising:

a card holding area in communication with said each conduit and said each opening, and, a blower for blowing air through said each conduit, to move the at least one card from the card holding area through the opening to the table.

8. The card distribution system of claim 7, additionally comprising: a controller for controlling: 1) the rotation of the cartridge into alignment with said each conduit for distribution of the at least one card to said each conduit, the controller responsive to a first signal; and, 2) the activation of the blower for blowing air through said each conduit, to move the at least one card from the card holding area through the opening to the table, responsive to a second signal.

9. The card distribution system of claim 8, additionally comprising an activator for generating the first signal and the second signal, in response to an activation of at least one of mechanical push button, or an activatable display box a computer display screen.

10. The card distribution system of claim 4, wherein at least two of the conduits are of different lengths.

11. The card distribution system of claim 10, wherein at least one of the conduits includes a bent portion.

12. The card distribution system of claim 4, wherein the card distributor and the plurality of conduits are under the table.

13. The card distribution system of claim 1, additionally comprising: a controller for controlling the rotation of the cartridge into alignment with said each conduit for distribution of the at least one card to said each conduit, the controller responsive to a first signal.

14. The card distribution system of claim 1, additionally comprising a shuffler, and, the cartridge is rotatable into communication with the shuffler.

15. The card distribution system of claim 1, wherein the at least one card includes one card.

16. The card distribution system of claim 1, wherein the at least one card includes a plurality of cards.

17. The card distribution system of claim 1, additionally comprising: a motor for rotating the cartridge.

18. A method for distributing playing cards to players comprising:

providing a card table comprising:

a table including a plurality of openings corresponding to positions on the table where players are to receive at least one card;

a card distributor comprising:

a rotatable cartridge configured for receiving a plurality of cards; and, a card remover in communication with the cartridge and rotatable with the cartridge, the card remover configured for removing at least one card from the cartridge by directly contacting the at least one card and for providing a pushing force directly on the at least one card; and, a plurality of conduits arranged around the card distributor and in communication with one of the openings of the plurality of openings, each conduit of the plurality of conduits arranged to receive at least one card from the cartridge when the cartridge has been rotated into alignment with said each conduit, such that said each conduit is in communication with the card remover, and, the pushing force from the card remover is sufficient for propelling the at least one card through said each conduit; and, subjecting at least one card to a pushing force to move the at least one card through said at least one conduit and pass through the opening onto the table.

19. The method of claim 18, wherein the subjecting the at least one card to the pushing force includes: subjecting the at least one card to a first propelling force such that the at least one card is moved into said at least one conduit, and, subjecting the at least one card to a second propelling force to move the at least one card in said at least one conduit through the opening onto the table.

* * * * *